US005631692A

United States Patent [19]

Maruyama

[11] Patent Number: 5,631,692

[45] Date of Patent: May 20, 1997

[54] PRINTING APPARATUS WITH LOWER TRANSPORTING SPEED BETWEEN PRINTING OPERATIONS

[75] Inventor: Ichirou Maruyama, Fukuoka, Japan

[73] Assignee: Matsushita Electric Industrial Co., Ltd., Osaka, Japan

[21] Appl. No.: 271,304

[22] Filed: Jul. 6, 1994

[30] Foreign Application Priority Data

Jul. 9, 1993 [JP] Japan ..... 5-170087

[51] Int. Cl.[6] ..... B41J 2/47

[52] U.S. Cl. ..... 347/262

[58] Field of Search ..... 347/262, 264, 347/248, 234, 139

[56] References Cited

U.S. PATENT DOCUMENTS 4,750,045 6/1988 Ohara et al. ..... 358/481

4,831,243 5/1989 Enari et al. ..... 235/436

*Primary Examiner*—Mark J. Reinhart

*Attorney, Agent, or Firm*—Panitch Schwarze Jacobs & Nadel, P.C.

[57] ABSTRACT

Printing data are memorized temporarily in a printing data memory unit 40 and then read out for printing on a printing medium 6, which is being transported by a pulse motor 10 first in a forward direction (this state is called "normal operation state"); and when all the data in the printing data memory unit 40 have been read out, the CPU 31 makes the motor control unit 32 shift to a "stand-by state", wherein by an operation pattern of the pulse motor 10 memorized in RAM 33 the pulse motor 10 transports the printing medium 6 at equal short lengths forward and backward at a lower speed than in the normal operation state; and thereafter the printing medium is transported at the same speed as that in the normal operation state; a smooth continuous printing with a memory of a relatively small capacity is performed.

4 Claims, 5 Drawing Sheets

PRINTING APPARATUS WITH LOWER TRANSPORTING SPEED BETWEEN PRINTING OPERATIONS

FIELD OF THE INVENTION AND RELATED ART STATEMENT

1. Field of the Invention

The present invention relates to a printing apparatus provided with memory for memorizing data to print.

2. Description of the Related Art

In recent years, information processing equipment (input device, hereafter) such as desktop publishing system has been developed much. As a result the system now can treat various data like characters, figures or graphic images, and printing apparatus to be connected to the input device is getting higher resolution in processing.

The above-mentioned information processing equipment or desk top publishing system generally comprises as shown in FIG. 5 an input device I (generally a personal computer including a keyboard K and a display D), a raster image processor RIP, which receives code data or image data from the input device I, and a printing apparatus P, which is for example a laser printer and receives printing data from the raster image processor RIP.

In the above-mentioned system, in order to make a high resolution printing, the file data prepared by using the input device I are sent from the input device I to the raster image processor RIP. In the raster image processor RIP, the code data are processed and rasterized to a data of an appointed resolution, and the processed data are sent to the printing apparatus P.

Hereinafter the words "input device" are used to imply the input device including the raster image processor RIP.

To treat higher resolution data, input device or printing apparatus is required to have larger memories because amount of data to be dealt is much increased. For instance, in case of printing in various resolution to a printing media (recording media with photosensitive material such as sensitive film, sensitive paper etc., ditto hereafter) of a same size, making resolution twice brings forefold data amount, which causes higher cost as corresponding large memory amount is needed.

In view of the above-mentioned situation, conventional printing apparatus including the raster image processor RIP is provided with such a memory as corresponding to about half page data for saving cost. And, printing process is made repeatedly by dividing one page into plural parts as follows: data of part of said one page are rasterized on memory, and after print out the data, paper transportation in printing apparatus is halted, the rest of data is rasterized on the memory, the paper transportation is restarted, and then the rest of data of printed out, and so on.

But, in case of the above-mentioned configuration, paper transporting motor repeats sudden stop and abrupt restart at every border part where data are divided, and this causes vibration and nonuniform paper transportation resulting in problems of degradation of printing quality. Moreover, paper transporting subsystem, motor for instance, bears heavy loads and therefore brings great consumption.

OBJECT AND SUMMARY OF THE INVENTION

The present invention proposes to solve the above-mentioned problems, and has, as its object, a provision of a printing apparatus which can print out high resolution data in good printing quality by using a memory of relatively small capacity.

In order to achieve the above-mentioned object, the printing apparatus in accordance with the present invention comprises:

printing data memory mean, printing means for making printing on a printing medium based on printing data inputted thereto from the printing data memory means, drive means capable of driving the printing medium forward and backward, system control means which issues a drive signal when printing data in inputted to the printing data memory means, and issues a stop signal when the printing means finished a printing, and drive control means for controlling the drive means in accordance with output signals given by the system control means.

In the printing apparatus of the present invention, printing data from an input device are memorized in a printing data memory unit, and a drive control unit is controlled by a control unit to drive in the normal operation state. Then as long as printing data is memorized in the printing data memory unit, the printing apparatus continues to print in a direction perpendicular to transporting direction of printing medium while a drive unit transports printing medium at constant revolution speed.

And then, when the printing data memory unit becomes to have no more data to be printed, the control unit makes the drive control unit transit to control of a stand-by state and make printing apparatus halt printing. The drive control unit controls drive unit by the operation sequences memorized in a stand-by operation memory unit.

Hence, in a stand-by state a drive control unit operates in the stand-by state in which printing medium, for instance, a paper sheet is moved forward and then backward by equal distances. In this period, the input device is provided next printing data and during this stand-by state next printing data are received and memorized in the printing data memory unit causing this unit to print again. And, when operation sequence of the stand-by state ends, the control unit resets the drive control unit to the normal operation state.

As the stand-by state succeeds to the normal operation state, the drive unit needs no special acceleration nor deceleration and carries out smooth transition from the stand-by state to the normal operation state, thereby eliminating vibration of printing medium. And, when printing medium comes back at the same position where transition to the stand-by state occurred and gets the same state as before the paper transporting speed (the driving unit gets above-mentioned fixed revolution speed), the control unit makes the printing apparatus restart the printing referring to horizontal synchronous signal of a line sensor.

By the above-mentioned operation sequence, the drive unit operates without sudden stop nor abrupt restart and vibration or other trouble of the printing medium is prevented resulting in good printing quality. Moreover, paper transport subsystem reduces its loads so consumption are diminished.

It will be recognized that some or all of the Figures are schematic representations for purposes of illustration and do not necessarily depict the actual relative sizes or locations of the elements shown.

DESCRIPTION OF THE PREFERRED EMBODIMENT

Configuration of an Embodiment

Figure 1:
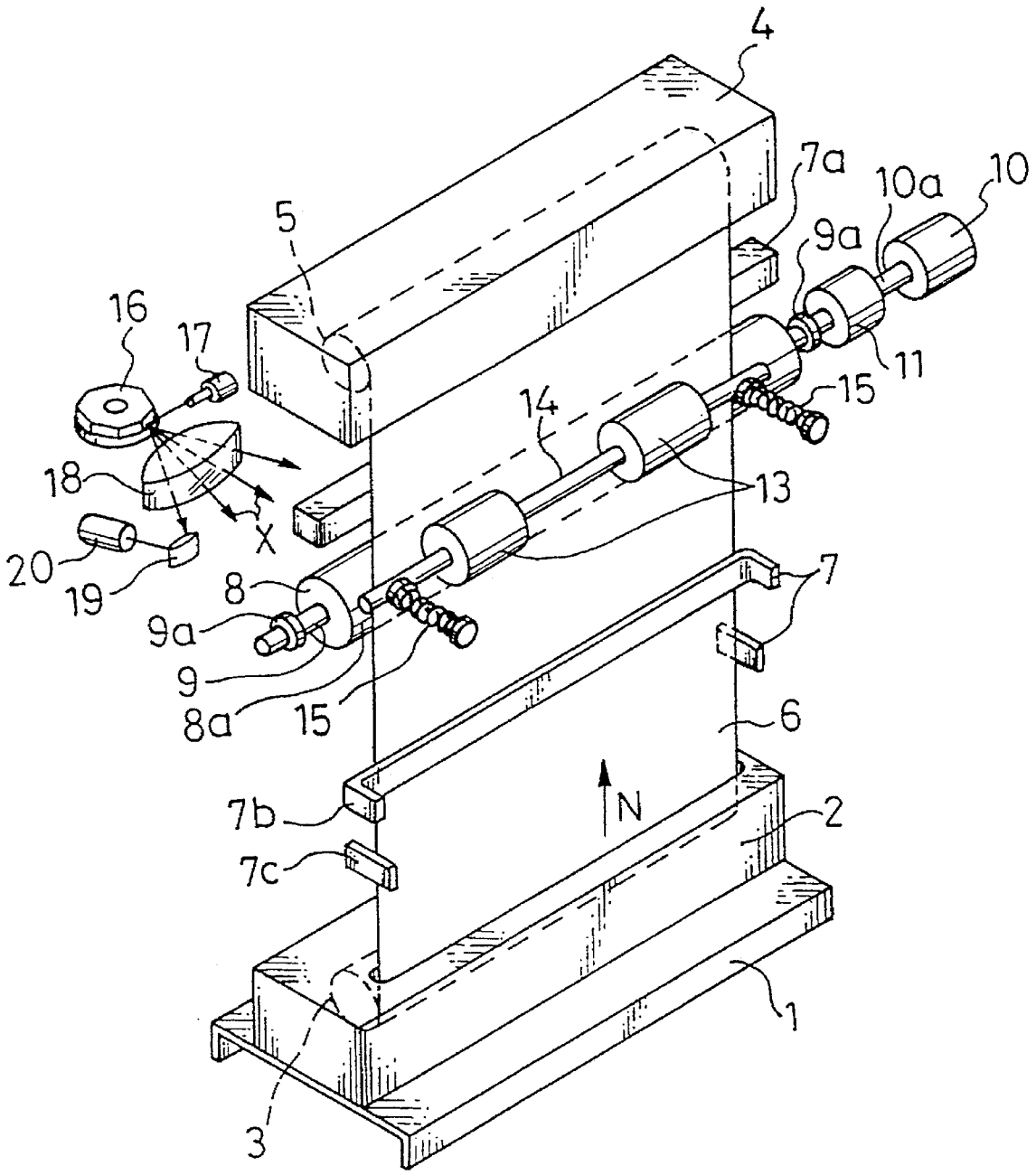
FIG. 1 is a perspective view of a printing apparatus built in accordance with an embodiment of the present invention.

FIG. 1 is a perspective view of a printing apparatus built in accordance with an embodiment of the present invention. Paper transporting subsystem is provided with a cartridge 2 on a cassette base 1. Printing medium 6, for instance, a paper sheet is fed from a feeder reel 3 inside the cartridge 2 and is winded by a winder reel 5 inside a magazine 4 through transportation guides *7a, 7b, 7c*. Arrow N shows transportation direction of the printing medium 6. A revolving axis 9 of a platen 8 is held by a pair of bearing *9a*. A driving shaft *10a* of a pulse motor 10 is connected to an end of the revolving axis 9 through a decelerator 11. The pulse motor 10 transports printing medium 6 forward or backward, revolving at desired speed. An axis 14 of a pressure roller 18, which is put in parallel with the platen 8, is pressed towards the platen 8 by a compression spring 15.

When the pulse motor 10 is driven, driving force of the driving shaft *10a* of the pulse motor 10 is transmitted to the revolving axis 9 through the decelerator 11, then the platen 8 revolves. And, the printing medium 6 is transported a direction of an arrow N (in lengthwise direction of the printing medium 6) in a state of being held between the pressure roller 13 and surface *8a* of the platen 8.

Laser beam X irradiated from a printing device 17 is reflected by a polygon mirror 16 and transmitted through a Fθ lens 18, and then printing is made in a widthwise direction N of the printing medium 6. As laser beam X is reflected by a mirror 19 every time laser beam X comes to a line head, a line sensor 20 generates horizontal synchronous whenever the line sensor 20 detects the reflected light.

Figure 2:
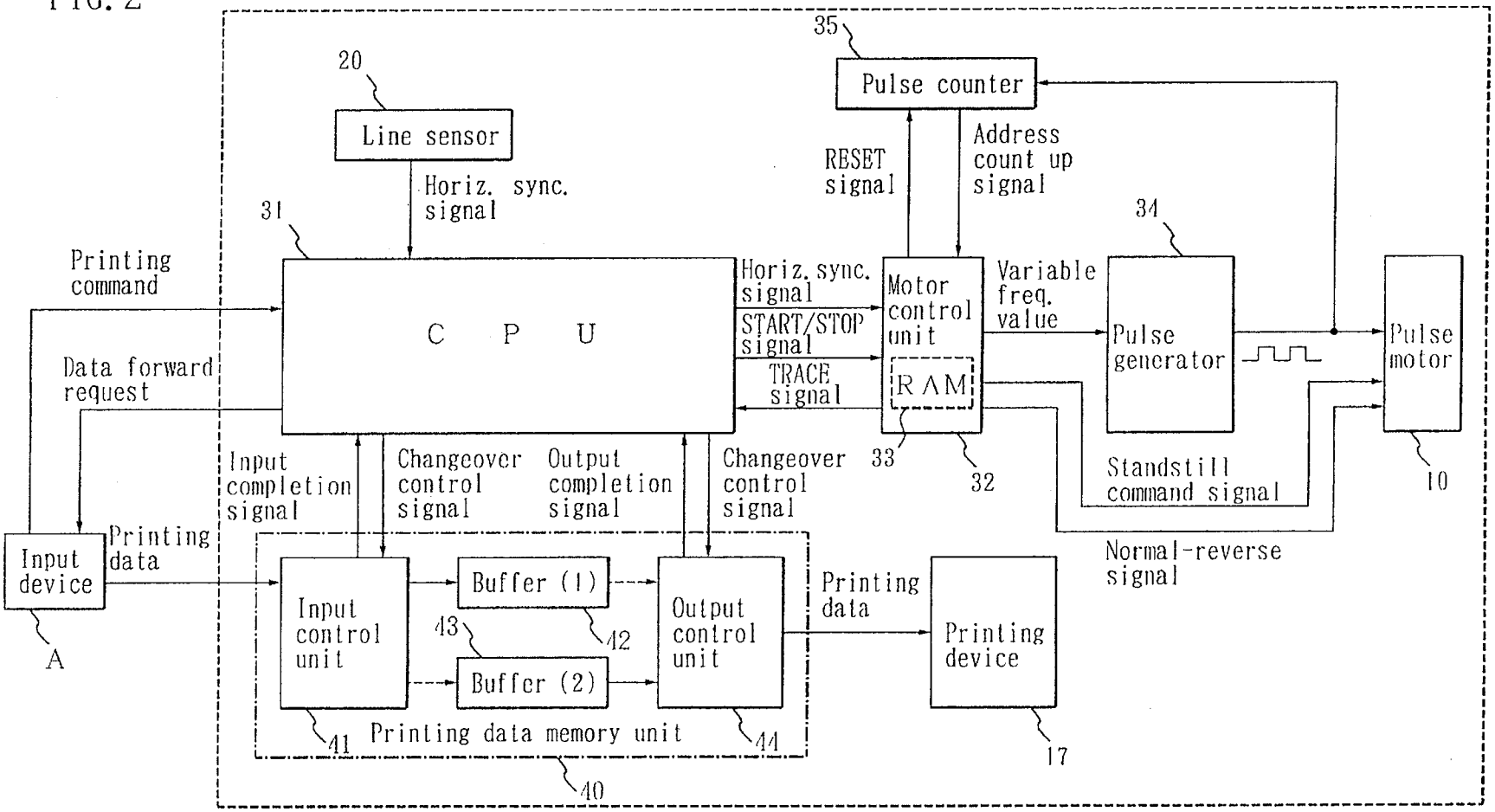
FIG. 2 is a block diagram of the printing apparatus of the embodiment FIG. 1.

FIG. 2 shows an input device A and a printing apparatus B. In a block diagram of the printing apparatus B, a CPU 31 is a control circuit which controls the whole printing apparatus B. A motor control unit 32 is connected to the CPU 31, a pulse generator 34, a pulse counter 35 and the pulse motor 10 and makes the pulse motor 10 run at a fixed revolution speed in normal operation state, and controls revolution speed and direction of revolution of the pulse motor 10 in accordance with operation pattern memorized in RAM 33 to act as a stand-by state memory unit in the stand-by state.

Apart from the configuration of FIG. 2 wherein the RAM 33 is provided in the motor control part 32, RAM 33 may be provided outside the motor control unit 32.

Figure 3:
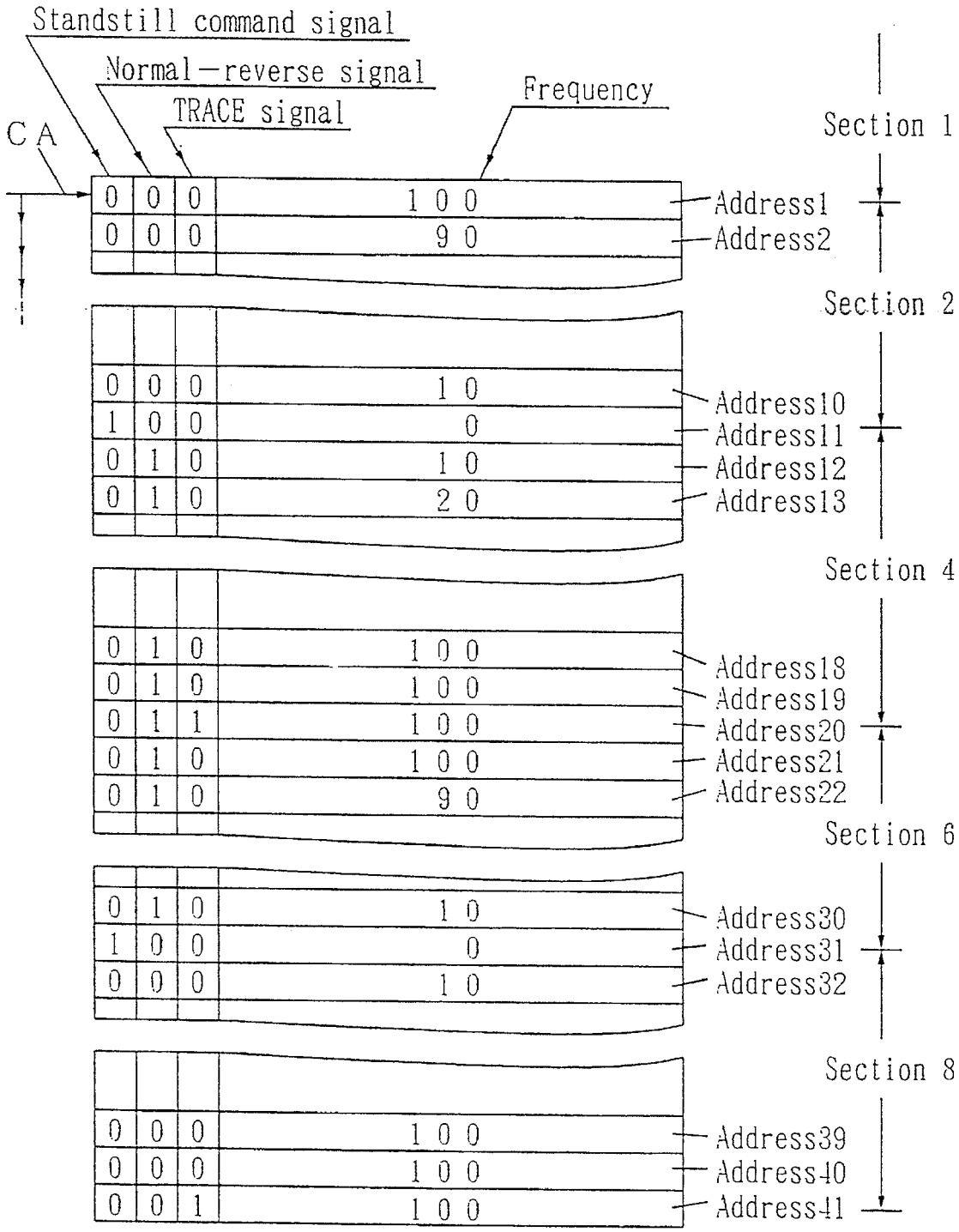
FIG. 3 is a data structure diagram is RAM of a printing apparatus of the embodiment of FIG. 1.

FIG. 3 shows signals to control the pulse motor 10, and operation patterns with these data patterns are memorized in RAM 33. As shown in FIG. 3, the top bit is a standstill command signal (active for standstill, inactive for non-standstill) which makes the pulse motor 10 stop completely. The second bit is a normal-reverse signal (active for normal revolution, inactive for reverse revolution) which shows direction of revolution of pulse motor 10. The third bit is TRACE signal (active for pre-running, inactive for non pre-running) that denotes start of reverse transporting section (reverse revolution section indicated at section 5 in FIG. 4) which will be explained afterwards or start of pre-running section (normal revolution section indicated at section 9 in FIG. 4) having the same length as reverse transporting section. And next unit contains data of given bits which indicate variable frequency value to be applied to the pulse generator 34 by the motor control unit 32.

And, these units are arranged in order of address. FIG. 2 shows an arrangement in one by one address manner, but this may be suitably modified. In FIG. 3, CA a pointer which is controlled by the motor control unit 32 and indicates top of these units. The position indicated by the pointer CA is renewed one by one by address count up signal which is issued by the pulse counter 35. That is, RAM 33 plays a role of sequencer which memorizes operation pattern in the stand-by state.

And, the pulse generator 34 generates rectangular wave in accordance with variable frequency value which the motor control unit 32 issues, and the pulse generator 34 applies it to the pulse motor 10. The pulse motor 10 revolves at higher speed responding to a rise of variable frequency value, and then the printing medium 6 is transported at higher speed. And in the normal operation state, variable frequency value is given a constant (100 in FIG. 3), and is given a variable value less than this constant (0~100 in FIG. 3) in the stand-by state. Therefore, the pulse motor 10 in the stand-by state revolves below the normal running speed or stops.

Even if variable frequency value is turned to zero, the pulse motor 10 revolves a little from circuit's structure, so the above-mentioned standstill command signal is issued to keep existing position of the printing medium 6.

The pulse counter 35 counts rectangular pulses which the pulse generator 34 issued, and sends address count up signal to the motor controller 32 in the case that the number of counted pulses reaches a given number. Therefore, when frequency of the rectangular pulse becomes high, the number of counted pulses reaches sooner to the fixed number, then the period of address count up signal becomes short.

In the normal operation state, the motor control unit 32 the neglects address count up signal. And at the beginning and at the end of the stand-by states the motor control unit 32 sends a RESET signal to the pulse counter 35 and initializes pulse number (counted number) in the pulse counter 35 to set the pointer CA to address 1 in RAM 33.

A printing data memory unit 40 receives and memorizes the printing data made by the input device A. The speed which the printing data memory unit 40 issues the printing data to the printing device 17 is faster than the speed which the input device A makes printing data and transmits these data to the printing data memory unit 40.

The printing data memory unit 40 is provided with an input control unit 41, a buffer 42, a buffer 43 and an output control unit 44. The input control unit 41 controls input of printing data from the input device A. The buffer 42 or 43 which memorizes printing data is connected to the input control unit 41 independently to each other.

And, CPU 31 issues a changeover control signal to the input control unit 41 so as to select and appoint either one buffer 42 or 43 to write printing data thereinto, and on the other hand, issues another changeover control signal to the output control unit 44 so as to select or appoint either one buffer 43 or 42 to read printing data therefrom.

These changeover control signals to the input control unit 41 and to the output control unit 44 are negative logic to each other. For instance, to write printing data into the buffer 42, memorized data in the buffer 43 are to be sent to printing device 17 through the output control unit 44 as shown in solid line in FIG. 2, and to the contrary, to write into the buffer 43, memorized data in the buffer 42 are to be sent to the printing device 17 through the output control unit 44 as shown in broken line in FIG. 2.

After received changeover control signal from the CPU 31, and when input of printing data to the appointed buffer is completed, the input control unit 41 sends input completion signal to the CPU 31. Similarly, after having received the changeover control signal from the CPU 31, and when output of printing data is completed, the output control unit 44 sends output completion signal to the CPU 31. As far as the printing data memory unit 40 in concerned, if input speed of printing data is lower than output speed, input completion signal issued out of the input control unit 41 arrives at the CPU 31 posterior to output completion signal of the output control unit 44.

Operation of the Embodiment

Signal flow and operation of an embodiment of this invention shown in FIG. 2 are as follows:

When preparation of printing data is completed in the input device A, the input device A sends printing command signal to the CPU 31 of the printing apparatus B. The CPU 31 sends a data forward (transfer) request signal to the input device A, and also sends to the input control unit 41 a changeover control signal for inputting the printing data is to be memorized to the buffer 42, and further sends to the output control unit 44 a changeover control signal for accepting printing data from the buffer 43.

When printing data are being written into the buffer 42 through the input control unit 41 but the buffer 43 has already finished to send output data to the output device, then the printing device 17 does not print, and the CPU 31 sends non-active START/STOP signal to the motor control unit 32.

Printing data are written into the buffer 42 at an output speed of the input device A, and when this writing finishes, the input control unit 41 sends input completion signal to the CPU 31. The CPU 31 turns over the changeover signals which are respectively sent to the input control unit 41 and the output control unit 44. Furthermore, CPU 31 sends an active START/STOP signal to the motor control unit 32 to make the printing device 17 print. The motor control unit 32 applies constant frequency value (corresponding to 100 in FIG. 3) to the pulse generator 34 in order to transport the printing medium 6 to transporting direction at a constant revolution speed.

Pulse motor 10 transports the printing medium 6 at a constant revolution speed based on the frequency received from the pulse generator 34. Then, the printing device 17 starts operation, and the horizontal synchronous signal is caught by line sensor 20. The CPU 31, referring to the horizontal synchronous signal, begins to issue the printing data from the buffer 42 through the output control unit 44 into the printing device 17 at higher rate than output rate of the input device A. In this way, process in the normal operation state restarts.

Figure 4:
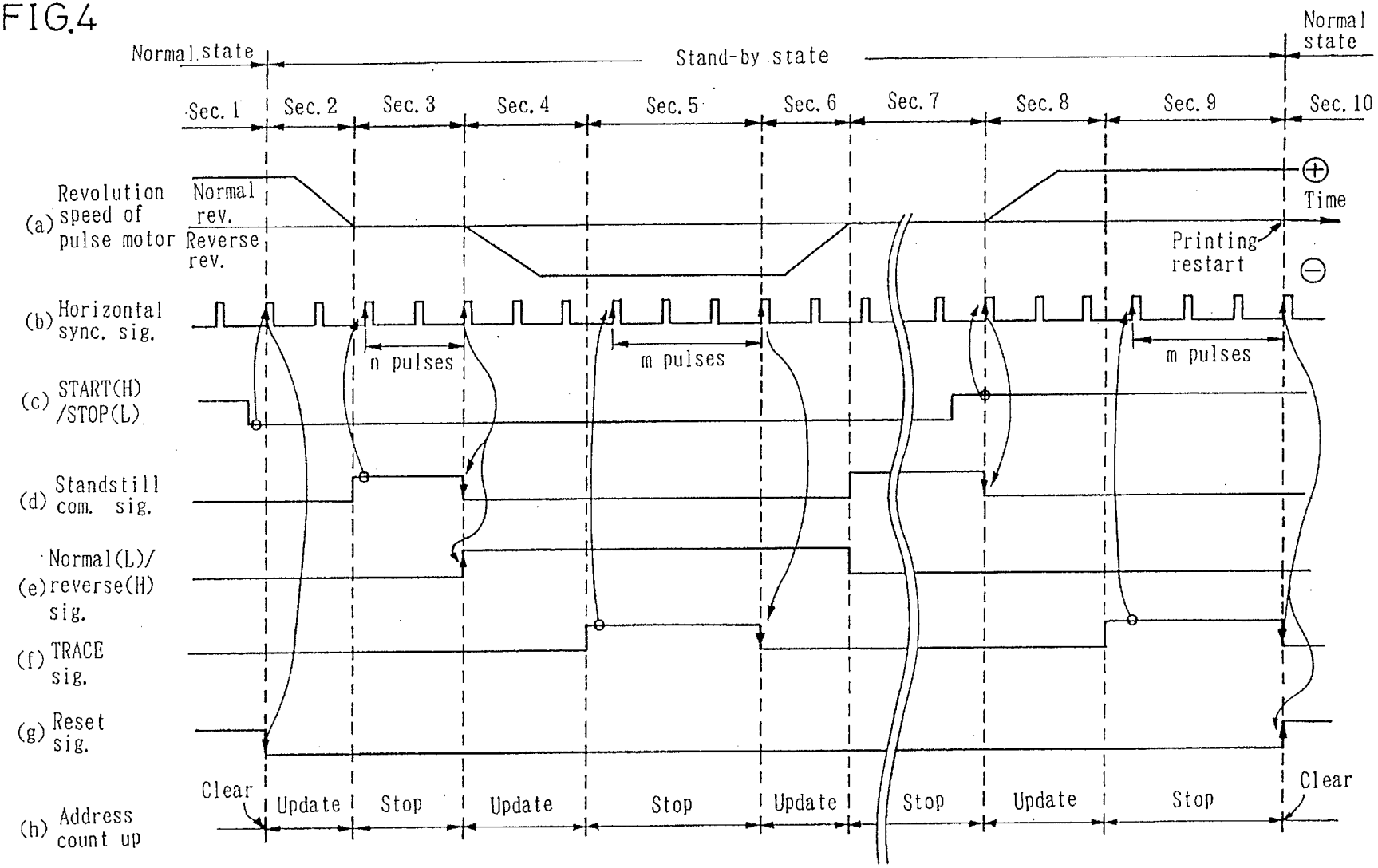
FIG. 4 is a time chart of a printing apparatus of the embodiment of FIG. 1.
Figure 5:
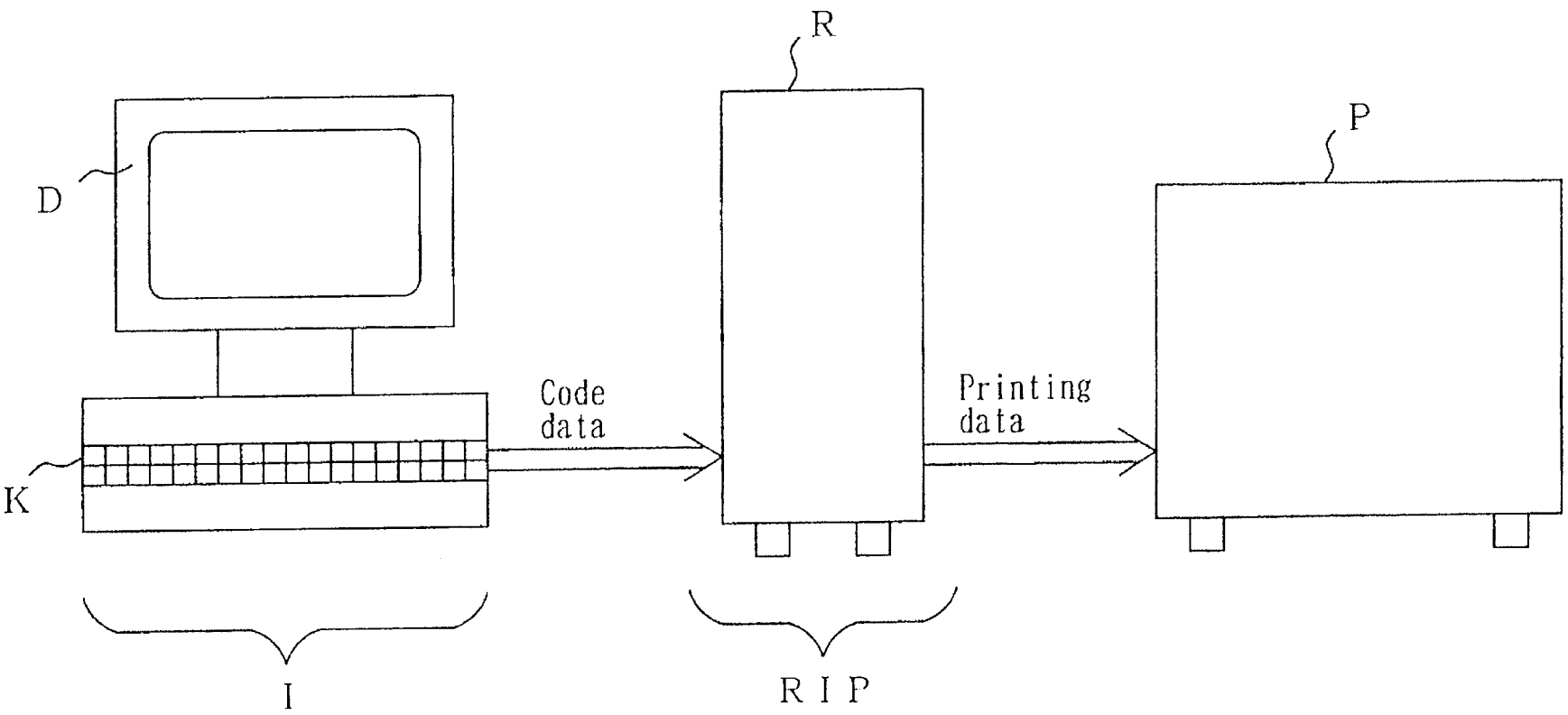
FIG. 5 (Prior Art)
FIG. 5 is a schematic diagram showing general configuration of the information processing equipment or the desk top publishing system.

FIG. 4(*a*), FIG. 4(*b*), FIG. 4(*c*), FIG. 4(*d*), FIG. 4(*e*), FIG. 4(*f*), FIG. 4(*g*), FIG. 4(*h*) are time charts that show an operation flow of the printing apparatus of the embodiment form a last part of the normal operation state, through the stand-by state and to an initial part of another normal operation state. FIG. 4(*a*) Shows time to revolving speed characteristic (revolving speed relates to variable frequency value issued by the motor control unit 32). In FIG. 4(*a*), positive side of ordinate corresponds to normal revolution and negative side corresponds to reverse revolution.

In FIG. 4(*a*) through FIG. 4(*h*), section 1 corresponds substantially to the last part of the normal operation state, sections 2 through 9 correspond to the stand-by state, and section 10 corresponds to the former part of the normal operation state.

Going into details, the section 2 is a uniform deceleration (normal revolution) section, the section 3 is a stop section and the section 4 in a uniform acceleration (reverse revolution) section. The section 5 is a reverse pre-running section to cancel the transportation in the section 9 (printing medium 6 is transported to transporting direction in the period starting at the time of shift from the stand-by state to the normal operation state and ending at the reopening of the operation of the printing device 17.

The section 6 is a uniform deceleration (reverse revolution) section, the section 7 is a stop section to wait until the printing data memory unit 40 becomes possible to issue printing data. The section 8 is a uniform acceleration (normal revolution section in which the pulse motor 10 accelerates to get a fixed revolution speed.

The section 9 is a pre-running section. The printing medium 8 is sent back keeping the fixed revolution speed to the initial position where the shift from the normal operation state to the stand-by state occurs. The section 10 is a printer reopen section wherein the printing device 17 reopens the printing operations.

Hereupon, each area enclosed by the curve and the abscissa in FIG. 4(*a*) denotes transporting length in the transporting direction N in section 2,8 and 9, and denotes transporting length in the direction reverse to N in section 4,5 and 6, and each area is equal to the other. The roll reverse transportation in the sections 4 through 6 is to cancel a slippage of the printing medium 6 yielded in the shifting period from a phase in the normal operation state to a corresponding phase in the next normal operation state. That is, by giving a pre-transportation of the printing medium 6 in reverse direction to the transporting direction N, continuous printing without slippage at reopening of the printing is realized. By the way, alteration of operation pattern is possible by renewal of data in RAM 33.

More detailed operation of each section is as follows: first, at section 1 of FIG. 4, printing data are sent out from the buffer 42 through the output control unit 44 to the printing device 17, and then printing to the printing medium 6 is made. When output of printing data to the printing device 17 is finished, the output control unit 44 sends an output completion signal to the CPU 31.

At this time, input of the next printing data is made also from the input device A to the input control unit 41. Since input speed from the input device is lower than output speed of the output control unit 44, when output of printing data to the printing device 17 finishes, writing of the printing data to the buffer 43 is not completed yet, and so the printing device 17 can not print. Then, in order to stop the normal revolution of the pulse motor 10, the CPU 31 changes the START/STOP signal which has been sent to the motor control unit 32 to non-active state. Then, the motor control unit 32 initializes the address in RAM 33 (to address 1), and sends the RESET signal to the pulse counter 35, thereby to initialize its count value. The motor control unit 32 further monitors the horizontal synchronous signal of the line sensor 20, and upon detection of the rise of horizontal synchronous signal Just after becoming of the START/STOP signal to non-active, the motor control unit 32 shifts to section 2. Thus, the operation shifts from normal operation state to stand-by state.

As shown in FIG. 3, operation pattern of address 1 of RAM 33 in now the same as the normal operation state, and the pulse generator 34 is given the same frequency (100) as that of the normal operation state, and the pulse motor 10 runs in the same revolution state as the normal operation state.

The pulse counter 35 counts rectangular pulses issued by the pulse generator 34 generates, and when counted number reaches a fixed number, the pulse counter 35 sends address count up signal to the motor control unit 32. Then, the motor control unit 32 updates address appointed by the pointer CA to address 2. At address 2, variable frequency is a little lower one (90) than that in the normal operation state (100), so that the pulse motor 10 gradually decelerates.

In the same way as above, the address appointed by the pointer CA is updated one by one to address 3 and thereafter, and then the pulse motor 10 gradually decelerates. When address 11 is appointed, variable frequency becomes zero, then the pulse motor 10 stops, and the motor control unit 32 shifts to section 3.

In section 3, the pulse motor 10 revolves a little by circuit's structure even when the variable frequency value becomes zero, so that standstill command signal turns to active in order to achieve a perfect stop. During a period that standstill command signal is active, that is, until a rise of n-th pulse (n=3 in this embodiment) of horizontal synchronous signal, pointer CA is stopped. The length of this stop period can be modified taking account of output speed of the input device A, output speed of the printing data memory unit 40 and other factors.

When the motor controller 32 detects rises of three pulses of horizontal synchronous signal, it shifts to section 4 and restores updating of the pointer CA, and the motor controller 32 shifts to address 12. Then the motor controller 32 sets standstill command signal in non-active state, allows the pulse motor 10 to revolve and turns over the normal-reverse signal to active state (reverse direction to the transporting N).

In section 4, whenever the address count up signal is issued, the address appointed by the pointer CA is updated and the variable frequency increases gradually. So that the pulse motor 10 accelerates gradually in the reverse direction of transporting N.

When pointer CA appoints address 20, the TRACE signal, which shows beginning of reverse transport section and pre-running section of the printing medium 6, becomes active (beginning of reverse transport section 9. Then, the motor control unit 32 shifts to section 5, and stops action of updating the address until the motor control unit 32 detects rises of m pulses (m=4 in this embodiment) of the horizontal synchronous signal. By this, the pulse motor 10 and horizontal synchronous signal are synchronized, and necessary length of the printing medium 6 is transported in the reverse direction to the direction of transporting N.

Next, upon detecting rises of four pulses of horizontal synchronous signal, the motor control unit 32 restores action of updating of address, and the pointer CA appoints address 21, and the control unit 32 shifts to section 6. Here, TRACE signal turns over to non-active state since a reverse transporting section is over. And, in the same way as above-mentioned, address appointed by pointer CA is updated one after another, and the motor control unit 32 waits the pulse motor 10 decelerates.

Then, pointer CA appoints address 31, standstill command signal becomes active, the pulse motor 10 stops completely, and normal-reverse signal turns over to the non-active (positive revolution state). And the motor control unit 32 shifts to section 7. And the pulse motor 10 waits until writing of printing data into the buffer 43 finishes.

When writing of printing data into the buffer 43 finishes, the input control unit 41 sends an input completion signal to the CPU 31. Then the CPU 31 turns over the START/STOP signal to active state in order to make the pulse motor 10 revolve in the normal direction, and the motor control unit 32 shifts its control to section 8. In section 8, the motor control unit 32 monitors and watches a first rise of horizontal synchronous signal, and when it is detected, advances pointer CA to address 32. At address 32, standstill command signal turns over to non-active state, in order to make the pulse motor 10 normally revolve and permit the motor to revolve in the transporting direction N. The motor control unit 32 updates the address and gradually accelerate the motor revolution, so that the motor comes to a predetermined speed of the normal operation.

When the pointer CA appoints address 41, TRACE signal turns over to the active state so as to enter the pre-running state, and the operation shifts to section 9.

In section 9, operations are made such that the paper transporting is made in the direction reverse to that of the transporting section (section 5). That is, the motor control unit 32 stops updating of the address in RAM 33, and further, when the motor control unit 32 detects the rise of the TRACE signal, the CPU 31 monitors horizontal synchronous signal and waits until the count of rises of horizontal synchronous signals comes to m which is equal to number of pulses of horizontal synchronous signals in section 5. The CPU 31 issues a changeover control signal to the output control unit 44, to make the buffer 43 give printing data. And then the printing device 17 restores printing of memorized data in the buffer 43.

On the other hand, at the same time, as a preparation to the next stand-by state, the address to show the pointer CA is initialized (to address 1), and further the RESET signal is made active, thereby to initialize the count number of the counter 35, so that the operation is restored from the stand-by state to the normal operation state (section 10).

Furthermore, in this embodiment the pulse motor 10 revolves normally and inversely. Therefore, backlash of decelerator 11 which is provided between the pulse motor 10 and the platen 8 is canceled.

Still furthermore, concerning control of operation or non-operation of the printing device 17, another embodiment may be provided with an element like a shutter which is to be controlled in such manner as to shade or stop the printing light output of the printing device 17.

As the above-mentioned, in the present invention the motor does not suffer from sudden stop or abrupt start, preventing vibration or other troubles in paper transporting subsystem. Therefore, good quality in printing and diminution of consumption of paper transporting subsystem are achieved. Moreover, a stoppage on the way of printing does not bring degradation of printing quality, and therefore high resolution data output with small capacity memory is realized.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A printing apparatus comprising:

printing data memory means for storing printing data, printing means for printing based on said printing data received from said printing data memory means, line sensor means which generates a horizontal synchronous signal of said printing means, drive means for driving a printing medium forward and backward at a given revolving speed, stand-by operation memory means for memorizing operation sequences of said drive means in a stand-by state, the stand-by state being followed by a normal operation state wherein said printing medium is transported at a fixed revolution speed in a transporting direction, said printing medium being driven forward and backward at equal lengths in the transporting direction at a lower revolving speed in the stand-by state than in normal operation state, drive control means for controlling said drive means to revolve the printing medium at a given revolving speed in the normal operation state, and for controlling revolving speed and revolving direction of said drive means in the stand-by state in accordance with operation sequences memorized in said stand-by operation memory means, and system control means for shifting said drive control means from the normal operation state to the stand-by state when said printing data memory means outputs printing data to be printed out, said system control means shifting said drive control means from the stand-by operation state to the normal operation state when said printing data memory means is ready to print more data, said system control means also controlling said printing means when said printing medium is set at a fixed position.

2. The printing apparatus in accordance with claim 1, further comprising pulse generating means for applying pulses to said drive means, pulse counting means for counting pulses issued by said pulse generating means and for issuing an address count up signal, and drive control means for issuing signals based on a frequency given to said pulse generating means in the stand-by state and for updating an address of said stand-by operation memory means by an address count up signal issued by said pulse counting means.

3. The printing apparatus in accordance with claim 1, wherein the operation sequences memorized in said stand-by operation memory means have a reverse transportation section to offset the transportation of the printing medium after a shift from the stand-by state to the normal operation state and until said printing means restores operation.

4. The printing apparatus in accordance with claim 1, wherein the operation sequences memorized in said stand-by operation memory means causes said printing means to reopen printing in synchronism with a rise of the horizontal synchronous signal generated by said line sensor means.

* * * * *